US009828008B2

(12) United States Patent
Keener

(10) Patent No.: US 9,828,008 B2
(45) Date of Patent: Nov. 28, 2017

(54) RAILROAD CAR DRAFT GEAR

(71) Applicant: Amsted Rail Company, Inc., Chicago, IL (US)

(72) Inventor: Scott A. Keener, Harrisburg, PA (US)

(73) Assignee: Amsted Rail Company, Inc., Chicago, IL (US)

( * ) Notice: Subject to any disclaimer, the term of this patent is extended or adjusted under 35 U.S.C. 154(b) by 186 days.

(21) Appl. No.: 14/738,321

(22) Filed: Jun. 12, 2015

(65) Prior Publication Data

US 2016/0362121 A1 Dec. 15, 2016

(51) Int. Cl.
*B61G 9/10* (2006.01)
*B61G 9/06* (2006.01)

(52) U.S. Cl.
CPC *B61G 9/10* (2013.01); *B61G 9/06* (2013.01)

(58) Field of Classification Search
CPC ... B61G 9/00; B61G 9/02; B61G 9/04; B61G 9/06; B61G 9/12; B61G 9/22; B61G 11/00; B61G 11/02; B61G 11/08; B61G 11/10
See application file for complete search history.

(56) References Cited

U.S. PATENT DOCUMENTS 1,876,019 A * 9/1932 Taylor ..... B61G 9/045 213/32 C
2,592,732 A * 4/1952 Peterson ..... B61G 9/10 213/34
6,478,173 B2 * 11/2002 Carlstedt ..... B61G 9/06 213/32 C
2008/0290058 A1 * 11/2008 Palermo ..... B61G 9/06 213/32 C

* cited by examiner

*Primary Examiner* — R. J. McCarry, Jr.
(74) *Attorney, Agent, or Firm* — Edward J. Brosius; Michael J. Krautner

(57) ABSTRACT

A railroad car draft gear is provided which includes a housing. The housing is a unitary structure, having an open end and a closed end. Compressible spring elements are located inside the housing, with an end of the spring element located against the interior side of the closed end. A friction assembly is also located within the housing, near the open end. The friction assembly provides energy absorption during compression cycles. The spring element restores the friction assembly to its fully extended position after a compression event.

7 Claims, 2 Drawing Sheets

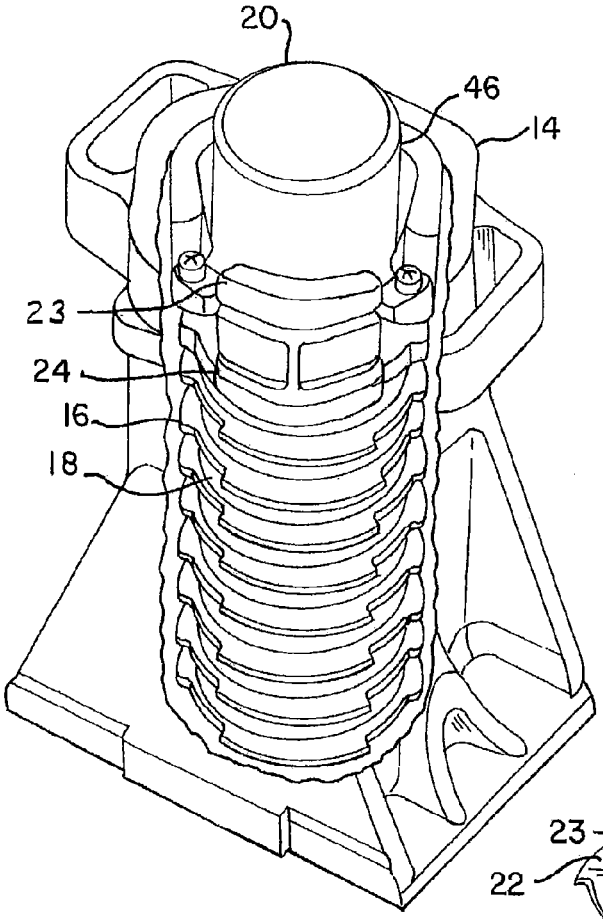
FIG. 3
FIG. 4
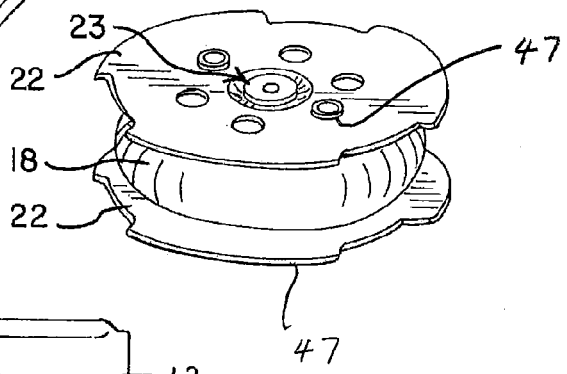
FIG. 5
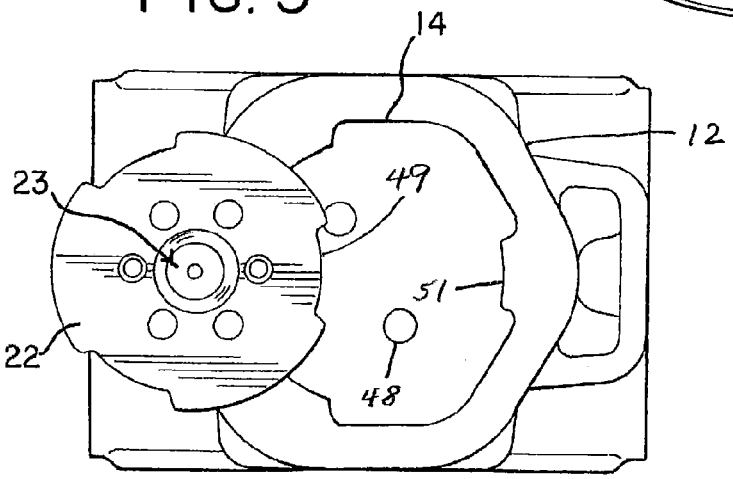

RAILROAD CAR DRAFT GEAR

RELATED APPLICATIONS

The application claims the benefit of U.S. provisional application 62/056,862, filed Sep. 26, 2014, the entirety of which is hereby incorporated herein by reference.

BACKGROUND OF THE INVENTION

The present invention relates to a railroad car draft gear and more particularly, to a railroad car draft gear having an improved, strengthened housing and an improved friction mechanism.

A railroad car draft gear typically comprises a housing in which a friction mechanism and spring are located. The friction mechanism and spring provide damping during a buff or compression event, when a railcar in a train is exposed to a deceleration or braking event. The spring restores the friction mechanism back to its fully extended position upon release of the braking event and typically upon a draft or acceleration event. The draft gear provides damping in draft as well once the neutral position is reestablished.

The draft gear housing must withstand axial compressive forces and radial stresses in the area of the friction mechanism.

SUMMARY OF THE INVENTION

The draft gear of the present invention provides an improved draft gear housing with improved fatigue resistance and strength due to the minimization of stress concentrations in the housing. The minimization of stress concentrations in the housing is accomplished by redesigning the housing to include more robust cross sections, along with more generous radii and blends of joining surfaces.

The spring element in the housing can be a steel coil spring. Further, the spring element can also be a combination of elastomeric pads and steel plates. The elastomeric pad embodiment is preferred due to its lighter weight and the ability of the elastomeric pads to absorb energy during a compression event. various elastomeric materials such as Hytrel, Arnitel, rubber or copolyester materials can be utilized. However, the preferred elastomer material for the spring of the present invention is Arnitel, available from the DSM company. This copolyester material is preferred due to its ability to be cold worked, good mechanical bonding to the steel plates, resulting spring and damping properties, toughness, resistance to compression set and stress relaxation, and broad application temperature range.

BRIEF DESCRIPTION OF THE DRAWINGS

In the drawings,

FIG. 3 is a perspective view of an elastomeric spring assembly inside a draft gear housing in accordance with an embodiment of the present invention;

FIG. 4 is a perspective view of an elastomeric spring element in accordance with an embodiment of the present invention, and FIG. 5 is an end view of a draft gear housing and an elastomeric spring assembly in accordance with an embodiment of the present invention.

DESCRIPTION OF THE PREFERRED EMBODIMENT

Figure 1:
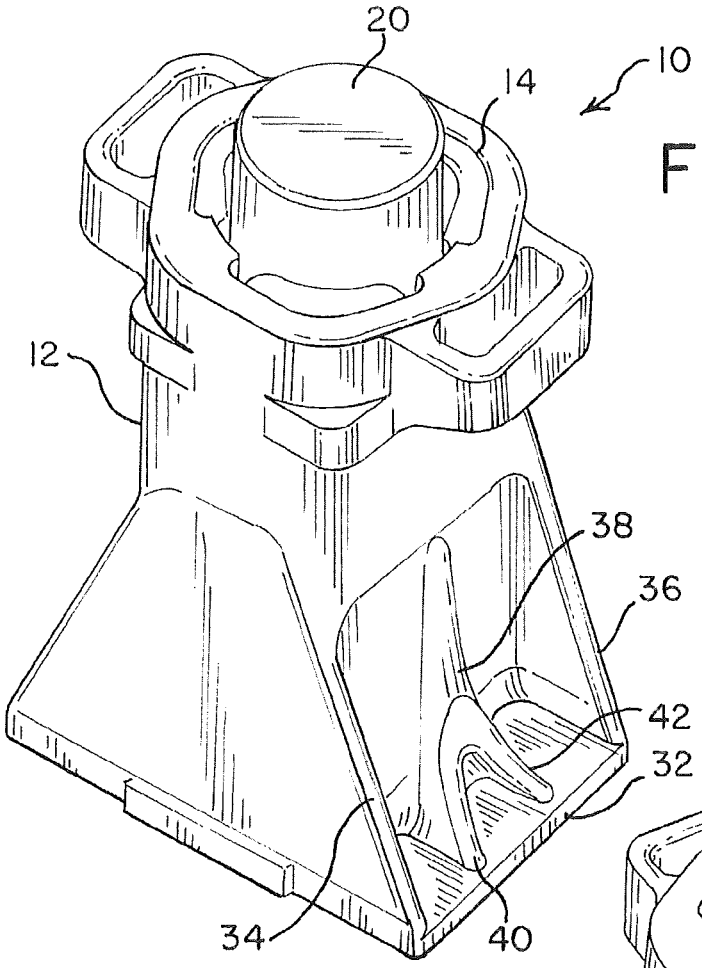
FIG. 1 is a perspective view of a draft gear assembly in accordance with an embodiment of the present invention.
Figure 2:
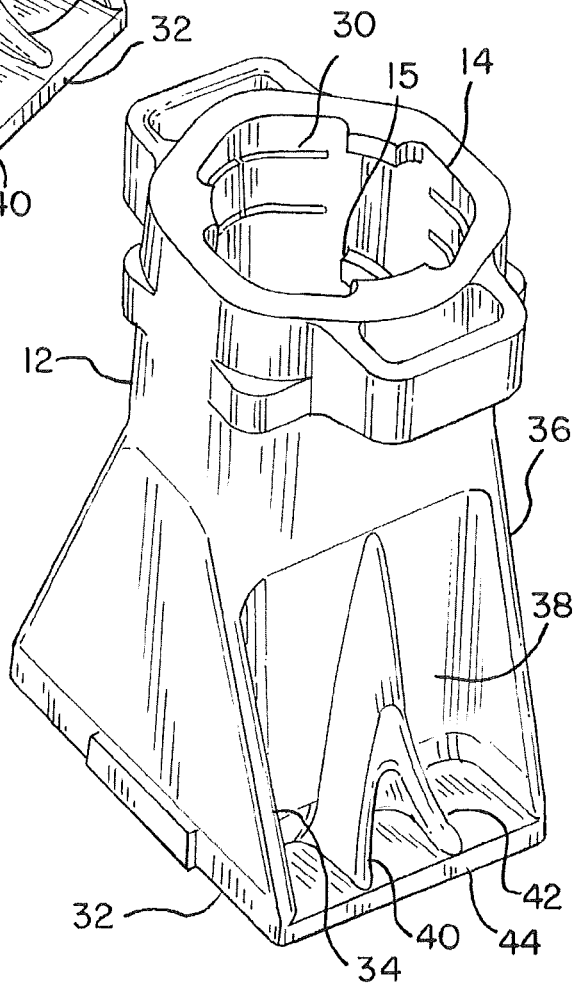
FIG. 2 is a perspective view of a draft gear housing in accordance with an embodiment of the present invention.

Referring now to FIGS. 1 and 2, a draft gear is shown generally at 10. Draft gear 10 is seen to comprise a draft gear housing 12. Draft gear housing 12 is an elongated, generally rectangular structure, with a central structure somewhat cylindrical in shape with external walls and internal wall surfaces forming an internal cavity. Front end 14 of draft gear housing 12 is preferably cast into a six sided structure forming an opening 30 leading into the internal cavity 15, but it should be understood that a four or eight sided structure could also be considered embodiments of the present invention. The walls of draft gear housing 12 at front end 14 are about 1 inch (2.54 cm) in thickness to provide improved strength and reductions in stress concentrations. Draft gear housing 12 is usually formed in a casting operation, with finish machining, and is usually comprised of steel.

Draft gear housing 12 also comprises rear end 32. Draft gear housing rear end 32 is usually comprised of a closed steel plate structure that is part of the unitary casting of draft gear housing 12. Rear end 32 has a thickness of about 1.3 inch (3.3 cm).

Draft gear housing 12 also comprises edge supports 34 and 36, each of which is seen to be an integral, generally triangular structural member that has a top portion that extends from a point about half way between front end 14 and rear end 32 on the body of draft gear housing 12 and a bottom portion that extends to a line of intersection with an edge of draft gear housing rear end 32. In certain embodiments, the line of intersection of the bottom portion of each edge support extends for the entire length of an edge of the rear end. Draft gear housing edge supports are seen to be generally triangular in shape, with a thickness of about 0.63 inch (1.6 cm).

Draft gear housing 12 also comprises center rib 38 which is comprised of a raised rib extending from a point about half way between front end 14 and rear end 32 on the body of draft gear housing 12 to a point about one fourth the length of draft gear housing 12 from rear end 32. At such point, center rib 38, in a preferred embodiment, is split into two laterally spaced center rib base supports 40 and 42 to help reduce stresses in the housing. Each of center rib base supports 40 and 42 extend from an intersection with center rib 38 to an intersection with draft gear housing rear end 32. Note that center rib base supports 40 and 42 have footings that extend to edge 44 of rear end 32. In an alternative embodiment, center rib 32 could itself extend to an intersection with rear end 32. A similar center rib and base supports are present on the side of draft gear housing 12 not visible in FIGS. 1 and 2.

The lower $1/10^{th}$ 45 of the housing body 12 gradually increases in diameter starting from a position approximately $1/10^{th}$ up from the base (rear end 32) and ending at the base such that internal clearance is created to allow a steel plate 22 to be incorporated onto to last plastic spring element 18 for the purposes of superior spring stack alignment and guidance when compared to some prior art. Protrusions 47 on the steel plate 22 align with depressions (blind holes) 48 in the housing 12 base to provide said positional guidance. Shown in this embodiment is a pair of protrusion/hole features. It should be understood that multiple such pairings could be employed to increase manufacturing flexibility. Additionally, such protrusion/hole pairings are employed at the opposite end (top end) of the spring stack for similar reasons such that the Top Follower Plate 8 is oriented to, and provides guidance for the spring stack. Furthermore the protrusion/hole pairings are "clocked" such that a manufacturing reference is created for ease of the spring stack placement where the steel plate 22 "notch" (1 of 3) indicated by a "V" marking 49 aligns with the corresponding housing protrusion in the "3 o'clock" position 51 on the housing 12.

Referring now to FIG. 3, a view of draft gear 10 is shown with draft gear housing 12 opened in order to view friction wedge 20 and other internal components. Friction wedge 20 is seen to comprise a generally cylindrical structure having an end 46 that protrudes from opening 30 in front end of draft gear housing 12. Under a buff condition, wherein a train would be decelerating or a railroad car would otherwise be subjected to a compressive force through its coupler system, friction wedge 20 would be forced partially inward into the cavity of draft gear housing opening 30.

Draft gear 10 is further seen to comprise friction wedge shoes 22 on the outer surface of friction wedge 20. Friction wedge shoes 22 are usually present in a set of three, when draft gear housing 12 has a six sided configuration at front end 14. Friction wedge shoes 22 are seen to have an angled outer surface that corresponds to the interior surface of the draft gear housing near opening 30. Friction wedge shoes 22 are usually made of steel. Further, solid friction wedge bearings 27, usually made of brass, are present as raised linear surfaces on the outer surface of friction wedge shoes 22. Friction wedge shoes 22 with friction wedge bearings 27 provide a friction damping effect when draft gear friction wedge 20 is pushed inwardly into the draft gear housing 12 in a buff condition for the railroad car.

Draft gear 10 is further seen to comprise a series of stacked compression springs in the form of elastomer pads 18. Such a stack of compression springs extends into draft gear housing 12 to rest against the inner surface of rear end 32. Each elastomer pad 18 is pre-compressed between two circular plates 22. The usual material for circular plates 22 is sheet steel. The preferred material for elastomer pads 18 is a suitable copolymer, with Arnitel being the preferred material. The preferred number of compression springs in a typical railroad car draft gear in accordance with the present invention is about eight for normal freight car installations, but it should be understood that the number of compression springs can vary based on application.

What is claimed is:

1. A draft gear comprising:

a housing comprising an elongated, generally rectangular structure having external walls with internal surfaces forming an internal cavity, the housing further comprising a front end having edges forming an opening into the internal cavity, and a rear end forming a closed end of the internal cavity, the housing further comprising two integral edge supports, each edge support extending from a location about halfway between the front end and the rear end on an external wall of the housing to an intersection with an edge of the rear end, the housing further comprising two center ribs, each center rib being on an external wall of the housing and extending from a location about halfway between the front end and the rear end to a location about one fourth the length of the housing from the rear end and splitting into two laterally spaced center rib base supports to intersect with the rear end, a friction wedge within the cavity of the housing, the friction wedge comprising a head extending from the opening in the front end of the housing, the friction wedge further comprising at least one friction wedge shoe on the outer surface of the friction wedge, a friction wedge bearing extending from an outer surface of each friction wedge shoe, the friction wedge bearing being in contact with the internal surfaces of the housing, and further comprising a series of stacked compression springs comprised of a plurality of elastomer pads with adjacent elastomer pads separated by a circular plate, and wherein at least one circular plate has a locating protrusion, and wherein the housing rear end includes at least one hole to receive one of the locating protrusions on one of the circular plates.

2. The draft gear of claim 1 wherein the front end of the housing is formed into a six sided closed structure, and three friction wedge shoes are provided each with a friction wedge bearing in contact with the internal surfaces of the housing.

3. The draft gear of claim 2 wherein each friction wedge bearing is in contact with two internal surfaces of the housing.

4. A draft gear housing having an elongated structure having external walls with internal surfaces forming an internal cavity, the draft gear housing comprising:

a front end having edges forming an opening into the internal cavity, and a rear end forming a closed end of the internal cavity;

two integral edge supports, each edge support extending from a location about halfway between the front end and the rear end on an external wall of the housing to an intersection with an edge of the rear end;

two center ribs, each center rib being on an external wall of the housing and extending from a location about halfway between the front end and the rear end to a location about one fourth the length of the housing from the rear end and splitting into two laterally spaced center rib base supports to intersect with the rear end;

wherein the housing is configured to receive a friction wedge within the cavity of the housing, the friction wedge further comprising at least one friction wedge shoe on the outer surface of the friction wedge, a friction wedge bearing extending from an outer surface of each friction wedge shoe, the friction wedge bearing being in contact with the internal surfaces of the housing, wherein the housing is configured to receive a series of stacked compression springs comprised of a plurality of elastomer pads with adjacent elastomer pads separated by a circular plate, wherein at least one circular plate has a locating protrusion, and wherein the housing rear end includes at least one hole to receive one of the locating protrusions on one of the circular plates.

5. The draft gear of claim 4 wherein the front end of the housing is formed into a six sided closed structure, and three friction wedge shoes are provided each with a friction wedge bearing in contact with the internal surfaces of the housing.

6. The draft gear of claim 5 wherein each friction wedge bearing is in contact with two internal surfaces of the housing.

7. The draft gear of claim 4 wherein each integral edge support is comprised of a generally triangular structure that has a top portion that extends from a location about halfway between the front end and the rear end on an external wall of the housing and a bottom portion that intersects with an entire edges of the rear end.

* * * * *